United States Patent [19]

Odagaki

[11] Patent Number: 5,025,188

[45] Date of Patent: Jun. 18, 1991

[54] ELONGATE TUBULAR INCANDESCENT LAMP WITH FILAMENT SHORTING BARS

[75] Inventor: Toru Odagaki, Okayama, Japan

[73] Assignee: Ushio Denki Kabushiki Kaisha, Tokyo, Japan

[21] Appl. No.: 487,389

[22] Filed: Mar. 2, 1990

[30] Foreign Application Priority Data

Mar. 17, 1989 [JP] Japan ..... 1-29735[U]

[51] Int. Cl.[5] ..... H01K 1/02; H01K 1/24

[52] U.S. Cl. ..... 313/273; 362/219; 313/1

[58] Field of Search ..... 313/1, 273, 611; 362/219, 225

[56] References Cited

U.S. PATENT DOCUMENTS 2,042,963 6/1936 Rentschler et al. ..... 313/1 X
3,039,015 6/1962 Jolly ..... 313/279
3,983,441 9/1976 Northrup ..... 313/273 X
4,052,637 10/1977 Op de Beeck ..... 313/273 X
4,070,594 1/1978 Fuchi et al. ..... 313/1

*Primary Examiner*—Palmer C. DeMeo
*Attorney, Agent, or Firm*—Finnegan, Henderson, Farabow, Garrett & Dunner

[57] ABSTRACT

A tube type incandescent lamp having light-emitting parts and non-light-emitting parts, wherein a filament assembly comprises coiled filaments and short bars, which are arranged alternately, the short bars are separately held by their corresponding constricted portions provided in a tube envelope made of glass, and each of the light-emitting parts and the non-light-emitting parts is formed of a space portion surrounded by the tube envelope part between adjacent constricted portions. The outermost ones of the short bars in the filament assembly are shorter than the other short bars and two light-emitting parts are continuously formed at each outer portion of the incandescent lamp.

1 Claim, 1 Drawing Sheet

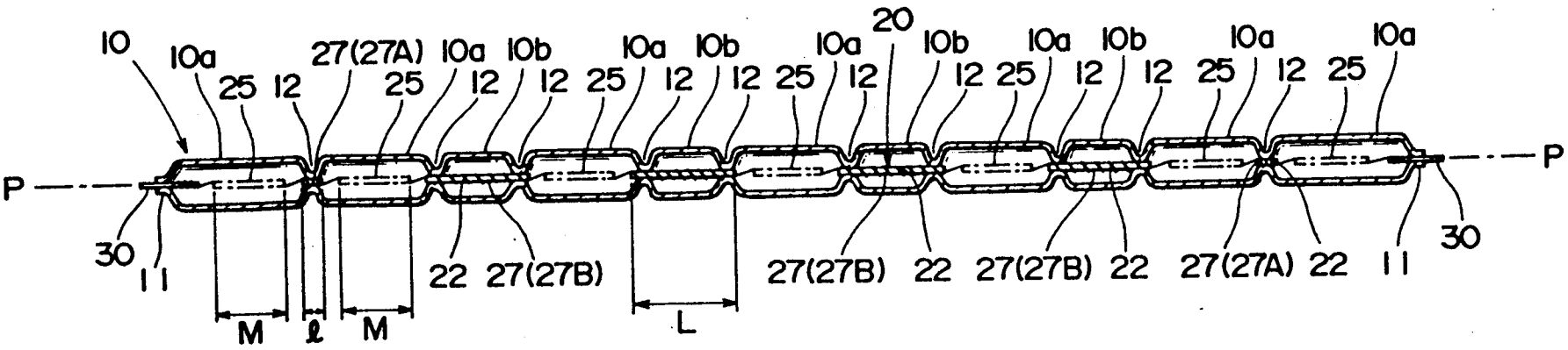
P
30
11
10a
25
12
22
27(27A)
10b
27(27B)
20
L
M
ℓ
10
P

ELONGATE TUBULAR INCANDESCENT LAMP WITH FILAMENT SHORTING BARS

BACKGROUND OF THE INVENTION

1) Field of the Invention

This invention relates to a tube type incandescent lamp having a structure in which short bars in a filament assembly are supported by their corresponding constricted portions formed in a tube envelope made of glass.

2) Description of Related Art

In tube type incandescent lamps used as the light sources for exposure by way of example, there has been a demand for a luminous intensity distribution that the light-emission intensity becomes higher at both outer portions thereof.

As a means for increasing the light-emission intensity at both outer portions of the tube type lamps, it has been known to date to use so-called differential light-emission type filament assembly in which coiled filaments and short bars are alternately arranged and both endmost ones of the coiled filaments are rendered longer.

On the other hand, in order to obtain a suitable luminous intensity distribution, it is necessary to situate a filament assembly along the tube axis of a glass-made tube envelope to hold it so as not to undergo displacement. As such a holding means, it has been known to provide constricted portions in the glass-made tube envelope so as to hold short bars by the constricted portions.

Now, a tube type incandescent lamp high in operation voltage requires a filament fine in wire diameter and a coiled filament formed of the fine-diameter filament is hence liable to be loose compared to that in a filament assembly used in a tube type incandescent lamp low in operation voltage. There has accordingly been a problem that when both endmost coiled filaments are rendered longer, they hang down due to their own weights, whereby a suitable luminous intensity distribution cannot be obtained.

SUMMARY OF THE INVENTION

With the foregoing circumstances in view, the present invention has been made and has as its object the provision of a tube type incandescent lamp having a structure in which short bars in a filament assembly are held by their corresponding constricted portions formed in a tube envelope made of glass and permitting the provision of a suitable luminous intensity distribution that the light-emission intensity becomes higher at both outer portions thereof.

In one aspect of this invention, there is thus provided a tube type incandescent lamp having light-emitting parts and non-light-emitting parts, wherein a filament assembly comprises coiled filaments and short bars, which are arranged alternately, the short bars are separately held by their corresponding constricted portions provided in a tube envelope made of glass, and each of the light-emitting parts and the non-light-emitting parts is formed of a space portion surrounded by the tube envelope part between adjacent constricted portions. The outermost ones of the short bars in the filament assembly are shorter than the other short bars and two light-emitting parts are continuously formed at each outer portion of the incandescent lamp.

According to this invention, the short bars situated outermost are shorter than the other short bars and each of the outermost short bars is held by one constricted portion, so that two coiled filaments situated at each outer portion in the filament assembly are close to each other so as to form two light-emitting parts continuously at each outer portion of the incandescent lamp. Therefore, said two light-emitting parts situated at each outer portion become a state close to each other, so that it is possible to obtain a luminous intensity distribution that the light-emission intensity becomes higher at both outer portions of the incandescent lamp. In addition, since each of the coiled filaments disposed separately in said two light-emitting parts can remain short, there is no potential problem that it hangs down due to its own weight so as to undergo displacement. It is hence possible to provide a suitable luminous intensity distribution free of any irregularity.

BRIEF DESCRIPTION OF THE DRAWING

The above and other objects, features and advantages of the present invention will become apparent from the following description and the appended claims, taken in conjunction with the accompanying drawing, in which:

The sole drawing FIGURE is an explanatory cross-sectional view showing a tube type incandescent lamp according to one embodiment of this invention.

DETAILED DESCRIPTION OF THE INVENTION AND PREFERRED EMBODIMENTS

Example

The present invention will hereinafter be described specifically by the following Example referring to the single FIGURE.

In this Example, a tube type incandescent lamp having a structure that a filament assembly 20 composed of coiled filaments 25 and short bars 27, which are arranged alternately, is disposed along the tube axis P of a glass-made tube envelope 10 by holding the short bars 27 by their corresponding constricted portions 12 provided in the glass-made tube envelope 10, as illustrated in the drawing, is fabricated by holding each of short bars 27B (hereinafter may also called "short bars not situated outermost") other than short bars 27A situated outermost in the filament assembly at both ends thereof by adjacent two constricted portions 12 and supporting each of both outermost short bars 27A, which have been shortened compared to the short bars 27B not situated outermost, by one constricted portion 12, whereby two light-emitting parts **10*a* are continuously formed at each outer portion while light-emitting parts 10*a* and non-light-emitting parts 10*b* are alternately arranged at portions other than the outer portion. Each of the light-emitting parts 10*a* and the non-light-emitting parts 10*b*** is formed of a space portion surronding by the tube envelope part between adjacent constricted portions.

In the filament assembly 20, each of the coiled filaments 25 is formed of a close-winding coil, while each of the short bars 27 is fabricated by winding a loose-winding coil 22 around the outer surface thereof. These coil portions are made from a tungsten wire by way of example. The length M of each of said two coiled filaments situated at each outer portion may also be made longer than those of the other coiled filaments. The length of each outermost short bar is preferably 15 mm or shorter.

Numeral 30 indicates a lead rod and numeral 11 designates a sealing portion.

A glass tube, in which primary constricted portions have been formed at predetermined positions in advance, can be used as a glass tube for forming the glass-made tube envelope 10.

The prescribed constricted portions 12 can be formed by heating further these primary constricted portions to constrict them.

Based on the features as described above, when a tube type incandescent lamp of 250 W in rated power consumption and 175 V in operation voltage by way of example is fabricated, an example of its specific dimensions is as follows:

Inner diameter of the coil making up each coiled filament 25: 0.4 mm

Wire diameter: 0.086 mm (22.5 in terms of MG value)

Length M of each of two coiled filaments 25 situated at each outer portion: 7 mm Length of each of the other coiled filaments 25: 6 mm Length l of each of both outermost short bars 27A: 11 mm Length L of each of the short bars 27B not situated outermost: 28 mm.

According to this Example, the short bars 27B not situated outermost are separately held at both ends thereof by the constricted portions 12. It is hence possible to sufficiently prevent the short bars 27B from being unsteady even if they are longer.

The length l of each outermost short bar 27A is shorter than the length L of the short bars 27B not situated outermost, and each outermost short bar 27A is held by the sole constricted portion 12. Therefore, two coiled filaments 25 situated at each outer portion and putting the outermost short bar 27A therebetween become a state close to each other, whereby two light-emitting parts **10*a*** are continuously formed at each outer portion.

As a result, it is possible to provide a tube type incandescent lamp having a desired luminous intensity distribution that the light-emission intensity of the lamp is increased at both outer portions thereof while controlling the length M of each outer coiled filament 25 to such a length that it does not hang down due to its own weight.

Having now fully described the invention, it will be apparent to one of ordinary skill in the art that many changes and modifications can be made thereto without departing from the spirit or scope of the invention as set forth herein.

What is claimed is:

1. In a tube type incandescent lamp having light-emitting parts and non-light-emitting parts, wherein a filament assembly comprises coiled filaments and short bars, which are arranged alternately, the short bars are separately held by corresponding constricted portions provided in a tube envelope made of glass, and each of light-emitting parts and the non-light-emitting parts is formed of a space portion surrounded by a part of the tube envelope between adjacent constricted portions, the improvement wherein the outermost ones of the short bars in the filament assembly are shorter than the other short bars and two light-emitting parts are continuously formed at each outer portion of the incandescent lamp.

* * * * *

UNITED STATES PATENT AND TRADEMARK OFFICE

CERTIFICATE OF CORRECTION

PATENT NO. : 5,025,188

DATED : JUNE 18, 1991

INVENTOR(S) : TORU ODAGAKI

It is certified that error appears in the above-identified patent and that said Letters Patent is hereby corrected as shown below:

Claim 1, column 4, line 25, before "light-emitting", insert --the--.

Signed and Sealed this

Twenty-third Day of February, 1993

*Attest:*

STEPHEN G. KUNIN

*Attesting Officer*

*Acting Commissioner of Patents and Trademarks*